United States Patent [19]

Flagg

[11] 4,369,700

[45] Jan. 25, 1983

[54] APPARATUS FOR SALVAGE COMPACTING

[76] Inventor: Rodger H. Flagg, 1415 Lynn Ave., Ft. Wayne, Ind. 46805

[21] Appl. No.: 184,820

[22] Filed: Sep. 8, 1980

[51] Int. Cl.[3] ..... B30B 9/32

[52] U.S. Cl. ..... 100/215; 100/218; 100/233; 100/272; 100/901

[58] Field of Search ..... 100/215, 218, 233, 270, 100/271, 272, 901

[56] References Cited

U.S. PATENT DOCUMENTS

| | | | |
|---|---|---|---|
| 2,932,244 | 4/1960 | Moyer | 100/901 |
| 3,266,413 | 8/1966 | Sharp et al. | 100/218 X |
| 3,356,018 | 12/1967 | Swint et al. | 100/271 X |
| 3,730,078 | 5/1973 | Flanagan | 100/901 X |
| 3,762,231 | 10/1973 | Patros | 100/215 |
| 3,796,151 | 3/1974 | Williams | 100/233 |
| 4,177,723 | 12/1979 | Buchele | 100/272 X |

*Primary Examiner*—Billy J. Wilhite
*Attorney, Agent, or Firm*—David A. Lundy

[57] ABSTRACT

An apparatus for compacting salvage. The apparatus has a crushing pad pivoted at one end to a generally horizontal frame. The crushing pad is moved from a generally vertical position to a generally horizontal position by a fluid cylinder assembly and articulate linkage to accomplish the crushing effort with improved compaction of salvaged material.

36 Claims, 12 Drawing Figures

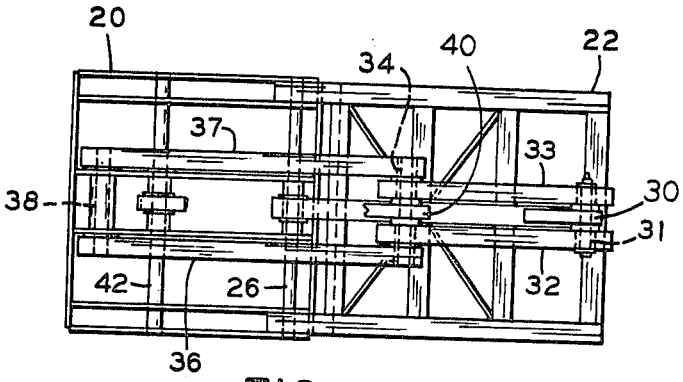
FIG. 3
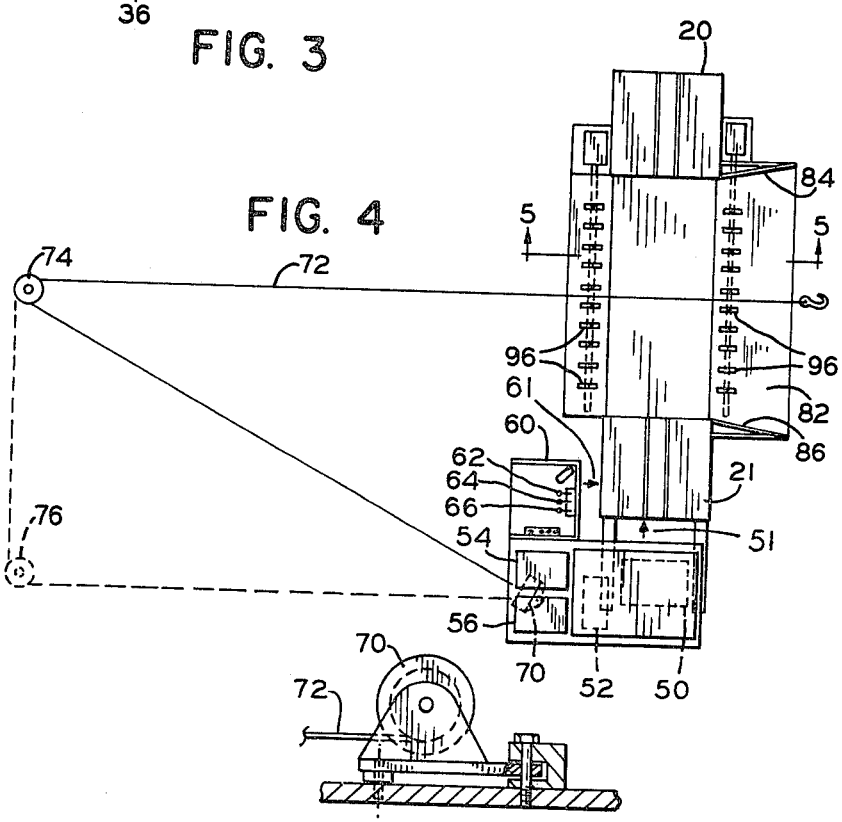
FIG. 4
FIG. 6
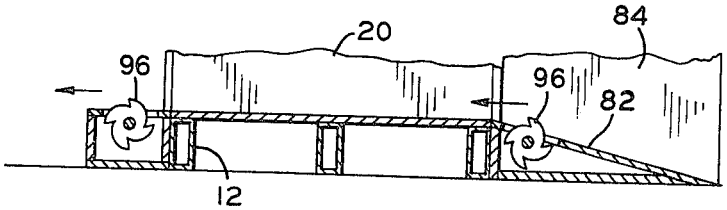
FIG. 5

APPARATUS FOR SALVAGE COMPACTING

BACKGROUND OF THE INVENTION

With rising energy costs, it has become very important to individual recycling centers to have available a relatively inexpensive and efficient means to compress builky items for salvage, such as automobile bodies, refrigerators, stoves and the like. The efficient compacting of salvage material offers significant savings in shipping and handling.

Earlier attempts of inexpensive units to meet the needs of smaller salvage operations have rarely been consistently successful in compressing auto bodies to uniform compaction, and have employed a direct hydraulic actuation that requires a long cylinder stroke; and due to design limitations, are least efficient at the end of the cylinder stroke, where the greatest compacting effort is required. As a result, compaction is often uneven around vehicle cowles, and the like, where greater resistance to compaction is inherent. This uneven compaction results in more handling and fewer cars per payload, reducing savings and efficiency. Prior models have also commonly employed overhead structures which serve to restrict visibility, limit the height of material to be compacted, and restrict loading from above, such as from an overhead crane or hoist. Further, the piston-cylinder assemblies commonly extend beyond the protection of their compactor structure, making them susceptible to damage. The prior art is exemplified in the following U.S. Pat. Nos.: 4,188,876, 3,844,209, 3,796,151, 3,564,994, 3,623,425, 3,356,016, 3,730,078, 3,554,121, 3,554,119, 3,545,369, 3,356,018, 3,651,754, 3,413,914, 3,101,045, 2,932,247, 2,932,244, 3,404,622, 3,641,927, 3,237,554, Canadian Pat. No. 814,178, Canadian Pat. No. 684,261, Canadian Pat. No. 612,940, Canadian Pat. No. 815,290

SUMMARY OF THE INVENTION

Therefore, one object of this invention is to provide an improved salvage compactor.

Another object of this invention is to provide an improved salvage compactor having fluid cylinder means providing arcuate movement of independent crushing pads through articulated link assemblies resulting in improved compacting pressures.

Another object of this invention is to provide an improved salvage compactor which is compact, relatively inexpensive, and durable.

Another object of this invention is to provide an improved salvage compactor with improved operator visibility by eliminating overhead structure inherent in many prior designs.

Another object of this invention is to provide an improved salvage compactor with improved crushing characteristics through the use of articulate linkage, wherein a fluid cylinder assembly is progressively retracted as the crushing pad moves from a generally vertical to a generally horizontal position.

Another object of this invention is to provide an improved salvage compactor having means to incrementally advance the object to be compacted between the opposing crushing pads.

Yet another object is to substantially protect the fluid cylinder assembly from damage by the framework and link arms in all positions of the assembly.

A further object of the invention is to provide an improved salvage compactor embodying any combination of the aforementioned objects.

These and other objects of this invention will be apparent to one of average skill in the art, from the disclosure of the following drawings, specifications, and claims.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein:

FIG. 3 is a partial top plan view of this embodiment of FIG. 1, showing the paired linkage assembly;

FIG. 4 is a partial top plan view of the embodiment of FIG. 1 showing a winch assembly and operator cab with optional rotating teeth, wherein linkage, crushing pad and piston cylinder assembly have been omitted for clarity;

FIG. 5 is a section view taken substantially along line 5—5 of FIG. 4 of the ramp and crushing bed, showing optional rotating teeth;

FIG. 6 is partial, side elevational view of a winch pulley assembly;

DESCRIPTION OF A SPECIFIC EMBODIMENT

Figure 1:
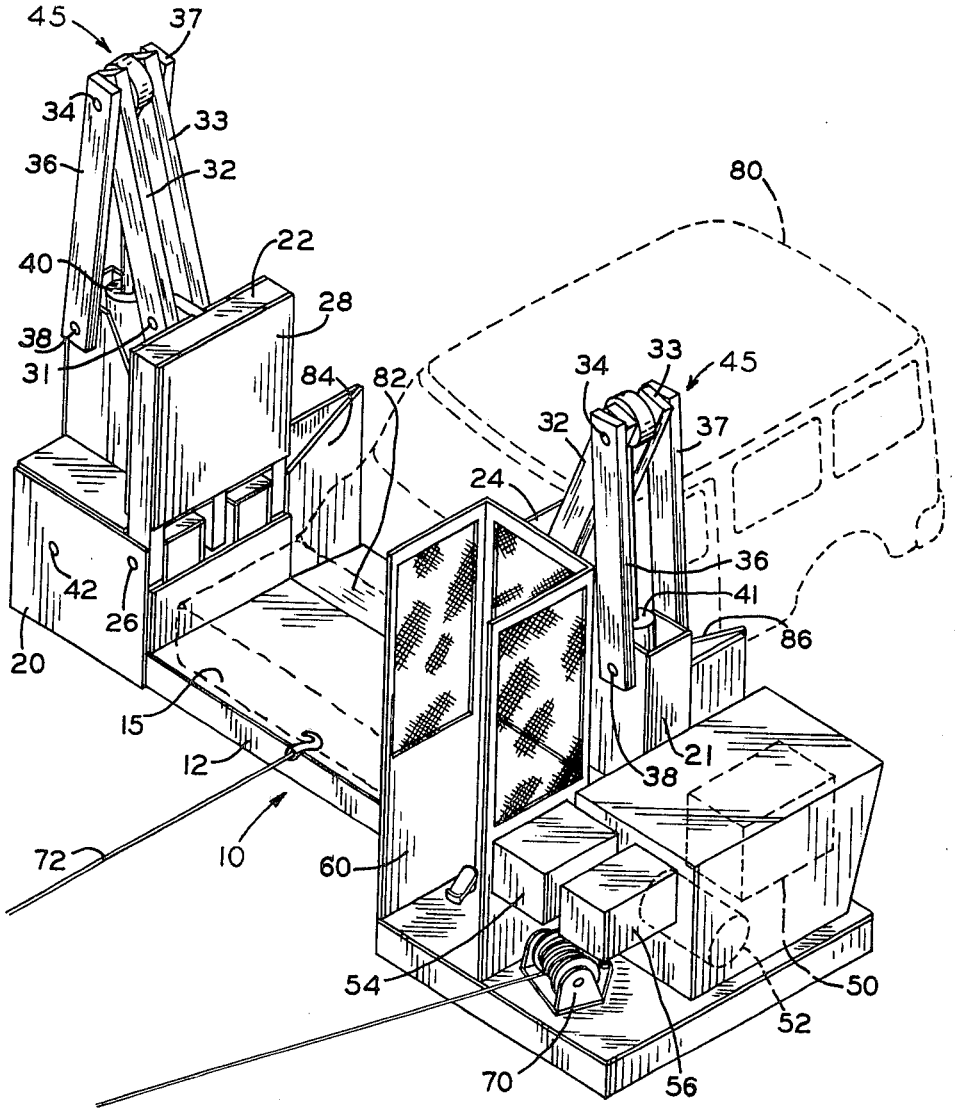
FIG. 1 is a view, in perspective, of an embodiment of this invention, with a vehicle body to be crushed shown in dashed lines.
Figure 2:
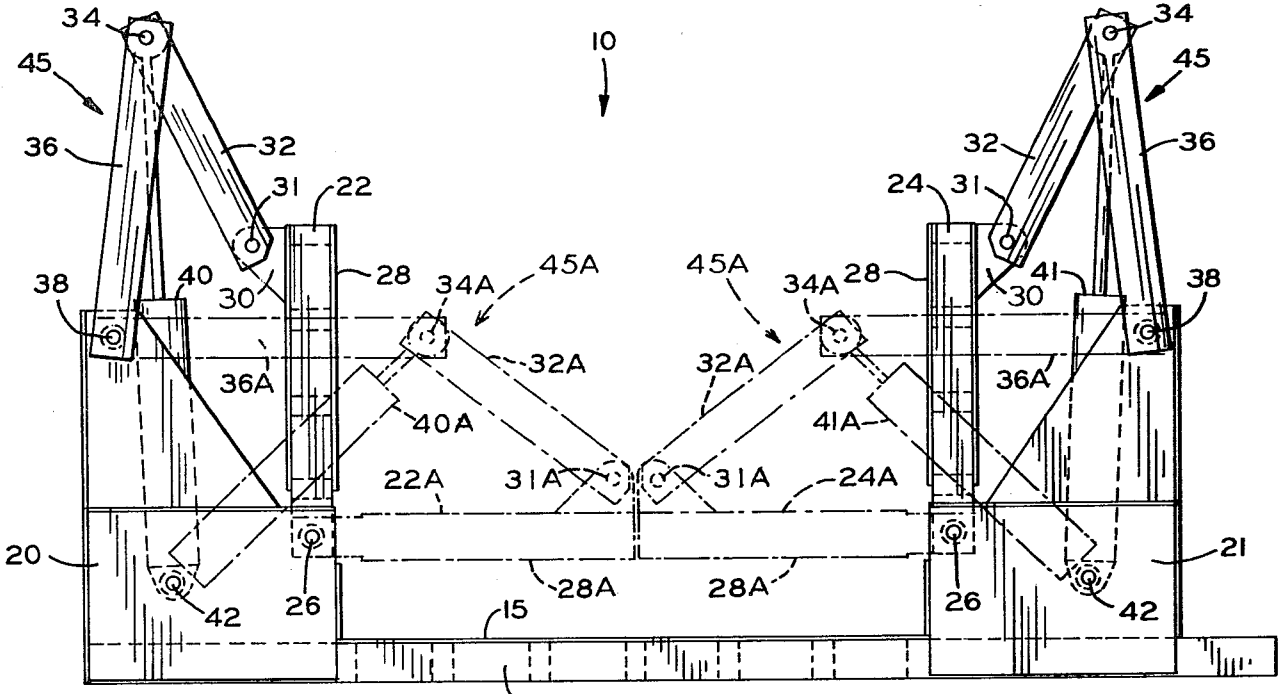
FIG. 2 is a partial view in front elevation of the embodiment of FIG. 1, showing the raised crushing pads in solid line and lowered crushing pads in dot-dash line.

Referring primarily to FIGS. 1 and 2 of the drawings, the metal salvage compactor 10 has a frame 12 with opposed raised ends 20, 21 on which crushing pads 22, 24 are pivotally connected at pivots 26, respectively, for arcuate movement from a generally vertical position to a generally horizontal position.

Each crushing pad 22, 24 has a crushing surface 28, and a mounting bracket 30, on which one end of a first set of paired link arms 32, 33 is adapted to be pivotably attached by pivot 31. The opposite ends of the arms 32, 33 are adapted to be pivotably attached by central pivot 34 to one end of second set of paired link arms 36, 37 which in turn are pivotably attached at their opposite ends by end pivots 38 to raised ends 20 or 21. First and second link arms 32, 33 and 36, 37, may be single or paired arms as shown, and together with their associated pivots and connections form a linkage assembly 45.

Fluid cylinder assemblies 40, 41 are adapted to be pivotably attached to raised ends 20, 21 by cylinder pivots 42. Each pivot 42 is positioned between the vertical projections of the associated pivots 38, 26. The opposite ends of fluid assembly 40, 41 are pivotally attached to central pivots 34 respectively, so that when extended, fluid assemblies 40, 41 move link assemblies 45 into solid line position shown in FIG. 2; and when retracted, fluid assemblies 40, 41 move link assemblies 45 into positions 45A shown in FIG. 2. When fully retracted, the fluid assemblies exert a force on crushing pads 22, 24 through the linkage assemblies 45A with fluid assemblies 40, 41 being at approximately 45°, as shown in positions 40A, 41A, while second arms 36, 37 approach a generally horizontal position, as shown in positions 36A, 37A.

Cylinder pivot 42 is located above the frame crushing surface 15 and below crushing pad pivot 26 and pivot 38 on arms 36, 37. This feature provides optimum leverage at full compaction of crushing pad 22 or 24. Also, since the cylinders 40, 41 move between a generally vertical position and an inward generally 45° position, they are at all times substantially protected by frame ends 20, 21 and link assembly 45. Since the fluid cylinder assembly provides support at the exit end of the cylinder, the bending moment on the fluid cylinder is reduced as the fluid cylinder is retracted as the crushing pad is lowered, and the resistance to the crushing pad movement is increased.

Figure 9A:
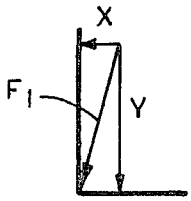
FIGS. 9A and 9B are simplified force diagrams diagramatically illustrating the component force vectors of the forces applied by a fluid cylinder in the embodiments shown in FIGS. 1 and 7 when the crushing pad is substantially vertical and horizontal, respectively.
Figure 9B:
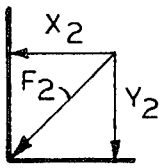

Referring to FIGS. 9A and 9B, force vectors X and Y of fluid cylinder assembly 40, 41 in positions $F_1$ and $F_2$ are shown. FIG. 9A shows fluid cylinder assembly nearly extended, and FIG. 9B shows fluid cylinder assembly retracted. In FIG. 9A, force $F_1$ acts through link assembly 45 to transmit a minor force along X, and a greater force along Y. As shown in FIG. 9B, when fluid cylinder assembly approaches 45°, force vector $F_2$ approaches nearly equal force along $X_2$ and $Y_2$, reducing resulting forces through link assemblies 45 to crushing pad 22, 24. Thus, a maximum 45° movement of fluid cylinder assembly 40, 41 is desirable, acting through link assemblies 45 as crushing pad 22, 24 moves approximately 90° from generally vertical to generally horizontal positions.

To operate the hydraulic assemblies 40, 41 in locations where hydraulic power is not readily available, engine assembly 50 or electric motor, is adapted to power a hydraulic pump 52 which provides for passage of hydraulic fluid between reservoir 54, valves 90, 92, and assemblies 40, 41.

An operators cab 60, commonly mounted at the inlet side of crushing apparatus 10, may be provided for added protection to the operator (not shown) during the crushing operation, and preferably is mounted on the discharge side of crushing apparatus 10. Mounting the operators cab on the discharge side gives improved visibility and is safer as there is less danger of flying glass caused by vehicle rear windows shattering when crushing is taking place near the front of the vehicle.

Within the operators cab 60, hydraulic controls 62, 64, 66 are adapted to selectively control valves 90, 92, 94 for independent or simultaneous operation of cylinders 40, 41 and winch 70 or rotating teeth 96. Other gauges and controls may be conveniently located within the operators cab. The winch 70 may be located in vicinity of the engine 50 for ease of hookup and may be hydraulically, electrically or manually controlled.

The winch line 72 is extended around a remotely attached pulley 74 and back through the approximate center of the crushing apparatus 10, and secured to the object 80 to be crushed. Object 80 is drawn up inclined ramp 82 and guided into position within the apparatus 10 by skid plates 84, 86. A second remote pulley 76 may be provided to remove line 72 from damage as the crushed object 80 is drawn by winch 70 toward pulley 74.

Control means 66 may be adapted to operate motor 98 to rotate teeth 96 positioned in relation to the inclined ramp 82 to engage and move the object to be crushed 80 through apparatus 10, eliminating the need for winch 70. When this option is employed, a second set of rotating teeth located on the discharge side of the apparatus 10 will aid in moving the crushed object 80 beyond the crushing apparatus 10 for ease of handling, where overhead loading is not used.

This design provides versatility by readily adapting inclined ramp 82, skid plates 84, 86, operators cab 60, and engine 50 to be mounted on either side of apparatus 10 to suit the needs of individual salvage operations. In the preferred embodiment, the operators cab 60 will be mounted on the discharge side of apparatus 10, with an access road on the opposite end of apparatus 10 from engine 50 and cab 60. This provides greatest safety for the operator during operation of apparatus 10, and during loading and unloading of apparatus 10 by forklifts, or the like, moving along the access road.

The hydraulic fluid lines may be adapted with conventional quick disconnects to simplify removal of engine 50, winch 70 and cab 60 to operate other equipment greatly reducing the cost of other equipment requiring engine, hydraulics and controls.

OPERATION OF THE INVENTION

For each of shipping and handling, the crushing apparatus 10 may be adapted to be separated from engine 50 and operators cab 60, as shown by arrows 51, 61 in FIG. 4. Once positioned and assembled, the object 80 to be crushed is placed on the inlet side near the inclined ramp 82. The crushing pads 22, 24 are pivoted into a generally vertical position.

Line 72 is guided from winch 70, around a remotely secured pulley 74, and extended through the approximate center of the crushing apparatus 10, and secured to object 80. Winch 70 is activated to reel in line 72, drawing object 80 up inclined ramp 82 between skid plates 84, 86, into position for crushing. Where available, this salvage compactor 10 may be loaded from above with overhead crane or hoist (not shown).

Fluid assemblies 40, 41 are selectively actuated to retract, acting through linkage assemblies 45 to pivotally move crushing pads 22, 24 from a generally vertical to a generally horizontal position, forcing object 80 to be crushed between the crushing pad surfaces 28 and the frame crushing surface or bed 15. One or both crushing pads may be lowered as desired. The confronting ends of pads 22, 24 are in close adjacency when the pads are horizontal, to prevent salvage material from extending upwardly therebetween, and to ensure a uniformly crushed object.

Once object 80 has been crushed to its desired thickness, fluid assemblies 40, 41 are extended to raise crushing pads 22, 24 to a generally vertical position, and winch 70 is activated to draw object 80 into position to continue crushing. Sequential crushing action is alternated with advancing object 80 through crushing apparatus 10 until the entire object is crushed and pulled free of apparatus 10.

Crushed object 80 is then ready for removal and another object to be crushed is brought into position near the inclined ramp 82, in preparation for the next crushing cycle. An object, such as a vehicle body, may require a number of sequential crushing and advancing steps to complete the crushing cycle. In the absence of a winch 70, object 80 may be pushed or pulled through apparatus 10 by any conventional means, or loaded from above.

A plurality of rotating teeth 96 may be mounted relative to inclined ramp 82, and may be controllably rotated to selectively engage and advance object 80 through the crushing cycle. A second plurality of rotating teeth 96 may be located near the discharge side of apparatus 10 to pull object 80 completely through apparatus 10 for ease of removal of crushed object 80. Alternatively, the crushed object may be vertically raised from the crushing surface while a second object is advanced by a winch or rotating teeth.

Figure 7:
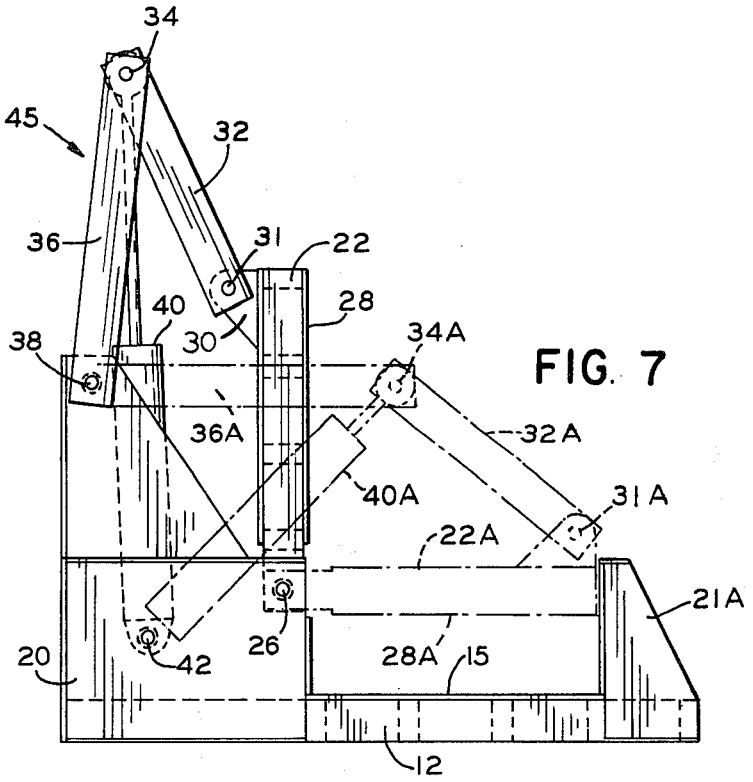
FIG. 7 is a side elevational view of an embodiment having a single crushing pad, showing raised crushing pad in solid line, and lowered crushing pad in dot-dash line.

For certain applications, it may be desired to have only one crushing pad 28, FIG. 7. When only one pad 28 is used, it is preferable to have an opposing upright raised stop or end 21A adapted to retain the salvage during crushing.

Figure 11:
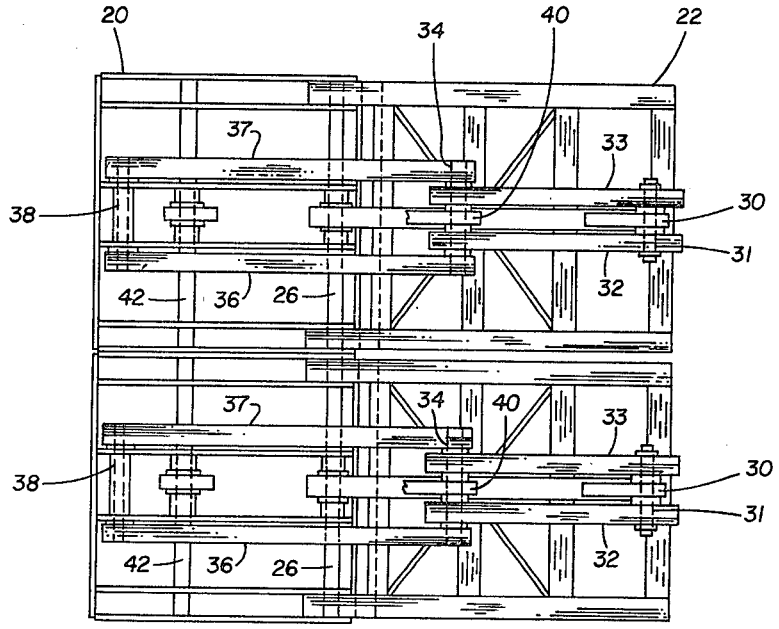
FIG. 11 is a top plan view similar to FIG. 3 showing another modified embodiment having two crushing pads in a side by side relation.
Figure 10:
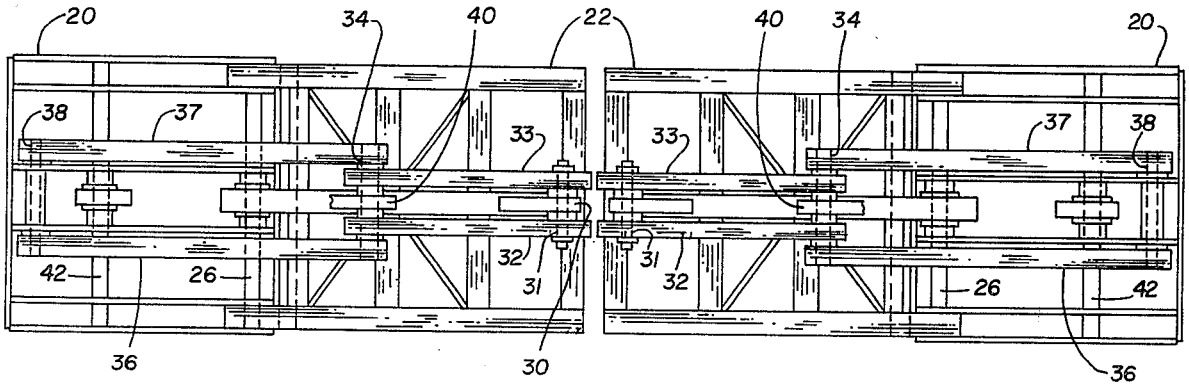
FIG. 10 is a top plan view similar to FIG. 3 showing a modified embodiment having two crushing pads in a side by side relation.

Other arrangements, such as shown in FIGS. 10 and 11 include side by side, multiple crushing pads with similar associated linkage and fluid cylinder assemblies, for crushing larger items. Also side by side pairs of opposing crushing pads, with similar associated linkages and fluid cylinder assemblies may be employed for conjoint or sequential crushing operation. When a plurality of side by side apparatus is used, the width of the frame and frame bed must approximate the width of the crushing pads to uniformly crush larger objects without advancing salvage.

Figure 8:
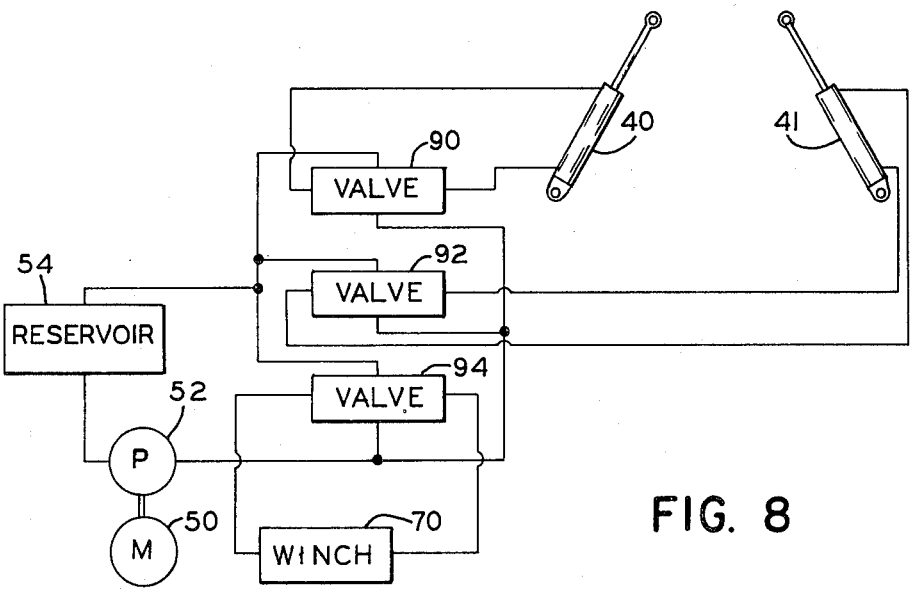
FIG. 8 is a schematic of the hydraulic circuit.

Referring to FIG. 8, motor 50 drives pump 52 that furnishes fluid under pressure to valves 90, 92, and 94. Reservoir 54 provides a low pressure supply for pump 52 and valves 90, 92, and 94. Valve 90 is coupled to fluid cylinder assembly 40 and is individually operable to direct fluid under pressure to either end thereof, in either direction. In like manner, valve 92 supplies pressure to fluid cylinder assembly 41, and valve 94 supplies pressure to winch 70. Valves 90, 92, 94 are actuated by control means 62, 64, 66 and are linked to reservoir 54 and may be operated separately or simultaneously, from cab 60. The hydraulic connections in the above circuit may be of the quick-release type and are conventional.

Thus, while the novel apparatus for crushing salvage has been fully described and disclosed, numerous modifications will become readily apparent to one of ordinary skill in this art, and such adaptions and modifications are intended to be included within the scope of the following claims.

What is claimed is:

1. An apparatus for compacting salvage comprising:

a generally horizontally disposed frame having a horizontal bed and having secured thereto a frame end upstanding from the frame bed; a crushing pad pivotably attached to said frame end and pivotable from a generally vertical position to a generally horizontal position; first and second link arms pivotally connected near first of their respective ends; said first arm pivotally connected near its other end to said pad; said second arm being pivotally connected near its other end to said frame end;

a fluid cylinder assembly having one end pivotally connected to said first ends;

said assembly also being pivotally connected to said frame end whereby extension of said fluid assembly will push said link arms to pivot said pad toward said vertical position and retraction of said assembly will pull said link arms to pivot said pad downwardly toward said horizontal position in a power crushing stroke while at the same time reducing the bending moment on the fluid assembly as the pad is lowered and the resistance to crushing pad movement is increased and as the salvage is compacted between the crushing pad and the frame bed.

2. The apparatus of claim 1 wherein the fluid assembly pivot connection to said frame end is generally between the pad frame connection and the pivot connection of said other end of said second arm to said frame end.

3. The apparatus of claim 1 wherein said fluid assembly is at a substantially 45° angle in relation to said pad when said fluid assembly is retracted and said pad is in said horizontal position.

4. The apparatus of claim 1 wherein said fluid assembly is contained within the confines of said frame end and said link arms in all operating positions.

5. The apparatus of claim 1 having an inclined ramp on the inlet side of said bed for moving said salvage relative to said bed.

6. The apparatus of claim 1, wherein said second link arm is pivotally secured to said frame end at a location above the crushing pad pivot location; and the fluid assembly is pivotally secured to the frame end at a location below said crushing pad pivot location.

7. The apparatus of claim 1 including a stop secured to said frame, said stop upstanding from said frame bed and horizontally spaced apart from said frame end to be in close adjacency to an end of said pad when said pad is in its generally horizontal position.

8. The apparatus of claim 1 wherein said fluid assembly pivotal connection to the frame end is between said pad pivot connection to said frame end and said second arm pivot connection to said frame end and below said second arm connection to said frame end.

9. The apparatus as claimed in claim 1 wherein the first and second link arms are of unequal length, and the second link arm is longer than the first link arm.

10. The apparatus of claim 1 including a second frame end horizontally spaced apart from said first frame end and upstanding from said bed;

a second crushing pad pivotably attached to said second frame end and pivotable from a generally vertical position to a generally horizontal position in close end to end adjacency with said first pad;

a second set of first and second link arms pivotally connected near first of their respective ends; said first arm pivotally connected near its other end to said second pad; said second arm being pivotally connected near its other end to said second frame end; a second fluid cylinder assembly having one end pivotally connected to said second set of first and second arm first ends; said second fluid assembly also being pivotally connected to said second frame end whereby extension of said second fluid assembly will push said second set of link arms to pivot said second pad toward said vertical position and retraction of said second fluid assembly will pull said second set of link arms to pivot said second pad downwardly toward said horizontal position in a power crushing stroke while at the same time reducing the bending moment on the fluid assembly as the pad is lowered and the resistance to crushing pad movement is increased and as the salvage is compacted between the crushing pad and the frame bed.

11. The apparatus of claim 10 wherein said second fluid assembly pivot connection to said frame end is generally between the second pad frame connection and the pivot connection of said other end of said second set second arm to said frame end.

12. The apparatus of claim 10 wherein said second fluid assembly is substantially at a 45° angle in relation to said second pad when said second fluid assembly is retracted and said second pad is in said horizontal position.

13. The apparatus of claim 10 wherein said second fluid assembly is contained within the confines of said second frame end and said second set of link arms in all operating positions.

14. The apparatus of claim 10 wherein said other ends of said second arms are pivotally connected to their respective frame ends above said pad pivot connections to their respective frame ends.

15. The apparatus of claim 10 wherein said first and second fluid assemblies are generally vertical when their respective pads are generally vertical, and said first and second fluid assemblies swing inwardly towards one another as said pads are pivoted downwardly.

16. The apparatus of claim 1, including operator control means for operating said fluid assembly.

17. The apparatus of claim 10 including operator control means for operating said first and second fluid assemblies independently from one another and for operating said fluid assemblies simultaneously and in synchronism with one another to extend and retract said assemblies.

18. The apparatus of claim 16 or 17 including an operator cab for protecting the operator and for housing said operator controlled means; said cab being positioned on the side of said bed from which the salvage is discharged.

19. The apparatus of claim 18 including means for quick release and installation of said operator control means and said cab to said fluid assemblies whereby said frame, frame ends, fluid assemblies, and link arms may be used and transported and stored independently of said operator control means.

20. The apparatus of claim 10 including operator control means for moving the salvage to and from said bed.

21. The apparatus of claim 20 wherein said means comprises a powered winch.

22. The apparatus of claim 20 including a first elongated surface on one side of said frame bed; said means comprises a first plurality of toothed wheels rotatably mounted relative to said first surface and having toothed portions extending above said first surface in salvage engaging position, said means further comprises means for selectively rotatably driving said toothed wheels to move the salvage relative to said bed.

23. The apparatus of claims 1 or 10 wherein said salvage may be loaded to or unloaded from the frame bed vertically or horizontally, whereby a multiplicity of loading and unloading apparatus may be selectively used.

24. The apparatus of claim 1 or 10, wherein said frame and crushing bed are of a width substantially equal to the width of the crushing pads, so that a plurality of apparatus may be positioned side by side to uniformly crush larger objects without advancing the salvage.

25. The apparatus of claim 10 wherein said second arms and second set second arms are longer than said first arms and second set first arms, respectively.

26. The apparatus of claim 10 wherein said first link arms are shorter than the dimension of said pads between said pad pivot connection and said pad ends.

27. The apparatus of claim 10 wherein said second link arms are generally horizontal when said pads are in said generally horizontal position.

28. The apparatus of claim 1 wherein said first link arm is shorter than the dimension of said pad between said pad pivot connection and said pad end.

29. The apparatus of claim 1 wherein said second link arm is generally horizontal when said pad is in said generally horizontal position.

30. The apparatus of claim 10 wherein said fluid assembly pivotal connections to the frame ends are between said pad pivot connections to said frame ends and said second arm pivot connections to said frame ends and below said second arm connections to said frame ends.

31. The apparatus of claim 10 wherein said second link arms are pivotally connected to said frame ends at locations above the crushing pad pivot locations; and the fluid assemblies are pivotally connected to the frame ends at locations below said crushing pad pivot locations.

32. An apparatus which comprises:

a. a generally horizontally disposed frame having raised frame ends;

b. a crushing bed disposed upon said frame between said raised frame ends;

c. opposed crushing pads mounted for pivotal movement near one of their respective ends above the crushing bed to respective ones of said raised frame ends;

d. a plurality of fluid cylinder means pivotably mounted to respective ones of said raised frame ends;

e. each crushing pad having first and second linkage arms, each pivotably secured near one end to each other and the free end of the fluid cylinder means, the opposite end of said first linkage arms adapted to be pivotably attached near the free end of one of the opposed crushing pads, and the opposite end of the second linkage arms being adapted for pivotal attachment to one of the raised frame ends;

f. whereby, said fluid cylinder assembly is adapted to transmit a force when extended, through the first and second linkage arms to raise the crushing pad to a generally vertical position, and when the fluid cylinder assembly is retracted, to transmit a force through the first and second linkage arms to lower the respective crushing pad to a generally horizontal position.

33. An apparatus for compacting salvage comprising:

a frame, a crushing pad pivotally attached to said frame, said crushing pad being pivotable between a generally vertical position and a generally horizontal position, a linkage assembly being connected between said frame and said pad, a crushing pad moving device being connected between said frame and said linkage assembly, said device being movable between extended and retracted positions, said device exerting a force on said linkage assembly to said crushing pad as said device is moved between said extended and retracted positions whereby said crushing pad moves between said generally vertical and said generally horizontal positions, respectively, said force having a vertical component which is always larger than or equal to one-half of said force including when said crushing pad is in a generally horizontal position.

34. An apparatus for compacting salvage comprising:

a frame having a salvage discharge side, a crushing pad pivotally attached to said frame, said pad being pivotable between a generally vertical position and a generally horizontal position, a linkage being connected between said frame and said pad, and a crushing pad moving device being connected between said frame and a position on said linkage between and spaced from said frame and said pad, said moving device being in a generally vertical position when said crushing pad is in a vertical position, said moving device being movable between extended and retracted positions and applying a crushing force to said pad as said moving device moves into a retracted position, and a control operatively connected to said moving device, said control being mounted on said frame adjacent said salvage discharge side.

35. An apparatus for compacting salvage comprising:

a frame, a crushing pad pivotally attached to said frame, said pad being movable between a generally vertical position and a generally horizontal position, a linkage assembly having a central pivot and being connected between said frame and said pad, and a crushing pad moving device being connected between said frame and said central pivot, said moving device pushing on said linkage to rotate said pad toward said vertical position, said moving device pulling on said linkage to rotate said pad toward said horizontal position, said moving device being positioned in approximately a vertical position when said pad is in said generally vertical position and in a position which is approximately 45° to horizontal when said pad is in said generally horizontal position.

36. An apparatus for compacting salvage comprising:

a frame, a crushing pad pivotally attached to said frame, said crushing pad being movable between a generally vertical position and a generally horizontal position, a linkage assembly being pivotally connected between said frame and said crushing pad, said linkage assembly comprising a first pair of link arms pivotally connected at one end to said crushing pad, a second pair of link arms pivotally connected at one end to said frame, the other ends of both of said first and said second pair of link arms being pivotally connected together by a central pivot, a fluid cylinder assembly movable between an extended and a retracted position, said fluid cylinder assembly being pivotally connected at one end to said frame and at the other end to said central pivot of said linkage assembly, said fluid cylinder assembly moving said crushing pad into a generally vertical position as said fluid cylinder assembly is extended, said fluid cylinder assembly moving said crushing pad into a generally horizontal position as said fluid cylinder assembly is retracted, said fluid cylinder assembly being located between said frame and said linkage assembly and exerting a force on said linkage assembly to said crushing pad as said fluid cylinder moves said crushing pad between said generally vertical and said generally horizontal position, said force having a vertical component which is always larger than or equal to one half of said force.

* * * * *